United States Patent [19]

Gasser

[11] Patent Number: 5,002,346

[45] Date of Patent: Mar. 26, 1991

[54] MEANS FOR POSITIONING THE FALSE FRONT OF DRAWERS

[75] Inventor: Ingo Gasser, Hoechst/Vlbg, Austria

[73] Assignee: Grass AG, Hoechst/Vlbg, Austria

[21] Appl. No.: 451,220

[22] Filed: Dec. 15, 1989

[30] Foreign Application Priority Data

Dec. 23, 1988 [DE] Fed. Rep. of Germany ..... 3843658

[51] Int. Cl.[5] ..... A47B 88/00

[52] U.S. Cl. ..... 312/348.4

[58] Field of Search ..... 312/263, 330.1, 348.4

[56] References Cited

U.S. PATENT DOCUMENTS

| | | | |
|---|---|---|---|
| 4,131,376 | 12/1978 | Busse | 312/263 X |
| 4,846,538 | 7/1989 | Rock et al. | 312/330.1 |
| 4,850,659 | 7/1989 | Rock et al. | 312/330.1 |
| 4,874,212 | 10/1989 | Rock et al. | 312/330.1 |

*Primary Examiner*—Joseph Falk

[57] ABSTRACT

A device for positioning the front panel of a drawer on an end frame of a respective lateral frame rail of a drawer includes a base plate attached to the front panel for mounting the front panel of the front side of the end face. A clamping panel is mounted on the back side of the end face and connected to the base plate by mounting screws. A wedge plate is arranged between the base plate and the front side of the end face for adjusting the inclination of the front panel. The mounting screws are laterally displaceable in holes formed in the end face for lateral adjustment of the front panel and vertically displaceable in the holes formed in the end face for vertical adjustment by means of an eccentric screw connected to the clamping panel having an eccentric pin extending into a slot formed in the end face and bearing on a lateral edge of the slot. The wedge plate has a positioning knob including projections which are engaged by indentions of the clamping plate to maintain the inclination of the front panel during lateral and vertical adjustment.

14 Claims, 7 Drawing Sheets

MEANS FOR POSITIONING THE FALSE FRONT OF DRAWERS

FIELD AND BACKGROUND OF THE INVENTION

The invention relates to an arrangement for positioning the front panel of drawers, pull-out units or the like, particularly for kitchen furniture, where lateral frame rails are provided with a front panel, and the front panel is designed to be moved by sliding or swivelling with positioning means, whereby a dowel base plate connected with the frame is arranged on the front panel and a wedge plate is inserted between the dowel base plate and the frame.

DESCRIPTION OF THE PRIOR ART

A means of this kind for positioning a front panel is already known as the subject matter of a patent application filed by the assignee, whereby the inclination of the front panel can be changed by means of a wedge plate to be inserted between the frame and the front panel and whereby the height of the front panel can also be positioned by displacement.

The disadvantage in this case, however, is that the front panel cannot be moved in a total of three directions and that, with movement in one direction, there can be an unwanted change in a previously set direction.

A means of the kind mentioned is also disclosed in another application made by the assignee (file number P 31 20 840.1-16) whereby the inclination of the front panel can be changed starting at the end face of the frame by means of a wedge, and the depth of the front panel can also be set.

A disadvantage in this case, however, is that no provision is made for displacing the front panel also vertically or laterally.

SUMMARY OF THE INVENTION

The object of the invention is thus to develop a means of the type mentioned, particularly a positioner for the front panel of drawers, pull-out units or the like so that the front panel can be adjusted in three directions independently of each other, particularly in inclination, vertically and laterally.

The invention achieves this object in that the front panel can be independently positioned in inclination, vertically and laterally by the provision of self-locking poistioning means starting at the end wall of the frame.

The basic idea of the invention is to arrange the positioning means for the front panel on the end wall of the frame, the front panel then being connected by fastening means with the positioning means, and to develop the positioning means in particular so that they are substantially self-locking in order that previously set directions are not changed when the front panel is shifted in another direction.

In development of the front panel positioning, the means is designed so that the inclination of the front panel can be set independently of the vertical and lateral positions by means of a wedge plate so that positioning in one direction does not affect the other directions.

Positioning of the inclination of the front panel is often carried out as the conclusion of positioning work, and there was always the risk up to now that the vertical and lateral positioning of the front panel could be changed thereby again.

In an advantageous development of the means, the end face of the frame has recesses and a slot for common mounting of all positioning means both for the inclination of the front panel and for vertical and lateral adjustment.

In an advantageous arrangement, all positioning means originate only at the end face of the frame, which makes it possible to give the front panel positioner itself a relatively simple constructional design.

The positioning means for the inclination of the front panel advantageously comprises a wedge plate, which is inserted between a dowel base plate mounted on the front panel and the end face of the frame, and a clamping plate is provided at the back side of the end face, which engages the projections of the positioning knob of the wedge plate with indentions.

In particular, the wedge plate to be displaced on positioning of the inclination of the front panel is thus secured on the additional clamping plate at the back side of the end face of the frame, particularly the positioning knob of the wedge plate, which is a simple way to provide self-locking with respect to a change in the inclination of the front panel.

In a further development of the invention, the wedge plate has projections and the dowel base plate has corresponding recesses for a locking zero position of the wedge plate.

Furthermore, the wedge plate advantageously has laterally tapered bevels guided in corresponding guides of the dowel base plate.

In one developement, the forward area of the wedge plate has a further wedge surface and a slot penetrated by a fastening screw of the false front. With the additional wedge surface in particular, this makes it possible to adjust the inclination of the front panel in the other direction as well depending on the extent to which the wedge plate is inserted. A relatively long positioning path of the wedge plate is achieved by means of the slot in the wedge plate, which can be penetrated by a fastening screw depending on the inclination adjustment of the front panel.

With reference to the change in inclination, the dowel base plate has a recessed region with wedge surfaces having opposing inclinations. Depending on the direction of slide of the wedge plate, this allows setting the inclination of the front panel in one direction or the other.

Furthermore, the upper end of the base plate has a flexure with lateral locking legs forming a slot to clasp a short area of the longitudinal edge of the frame starting at the end face of the frame.

This makes it possible to have a cover over a slot between the front panel and the end edge that can be formed by the positioning of the inclination. Besides providing for an attractive appearance, this avoids dust deposits between the front panel and the end face.

For vertical displacement of the front panel, the clamping plate advantageously has a bottom hole engaged by an eccentric screw, whereby an eccentric pin is braced against a lateral edge of a slot on the end face of the frame.

When the eccentric screw is turned, the clamping plate itself is displaced vertically by the braced eccentric pin, and the front panel is also displaced in connection with a slight loosening of the fastening screws.

In a development of the means for lateral displacement of the front panel, the fastening screws are displaced laterally in the recesses of the end face of the frame with lateral displacement at the same time of the clamping plate on which the eccentric screw for vertical adjustment and the positioning knob of the wedge plate for inclination adjustment are arranged in a self-locking way.

The inclination adjustment through displacement of the clamping plate is advantageously carried out around a fixed fulcrum formed by the fastening screws depending on the direction of inclination with maintenance of the position vertically and laterally through fixing of the clamping plate with the inclination adjustment.

A slight deformation of the front panel positioner with respect to the inclination is accepted in this case in order to carry out the adjustments without play along the lines of spring-loaded initial tension.

With the lateral adjustment of the front panel, the clamping plate is also advantageously displaced laterally with maintenance of either or both of the inclination and the vertical positioning through either or both locking of the positioning knob on indentations of the clamping plate and guidance of the eccentric pin in the horizontal slot of the end face of the frame.

With the vertical adjustment through the eccentric screw, the clamping plate is also displaced vertically and, without this adjustment being affected, either or both the inclination and the lateral positioning of the front panel are maintained through either or both clamping of the positioning knob and locking of the false front on the fastening screws.

In an advantageous development, the front panel locates through locking means on the positioning means at the end face of the frame.

It is advantageous here that, starting from either or both the end face of the frame and the positioning means of the panel front positioner, particularly starting from the fastening screws, pincer-like or clamping connection or tension components are provided on which the front panel locks along the lines of furniture connectors.

The invention is explained in more detail below by means of drawings illustrating a number of embodiments. The drawings and their description will indicate further essential features and advantages of the invention.

The subject matter of the present invention is indicated not only by the subject matter of the individual patent claims but also by a combination of the individual patent claims with each other. All data and features disclosed in the documents, including the summary, particularly the spatial configurations represented in the drawings are claimed as essential to the invention to the extent that they are novel compared to the prior art either individually or in combination.

DETAILED DESCRIPTION OF THE DRAWINGS

Figure 1:
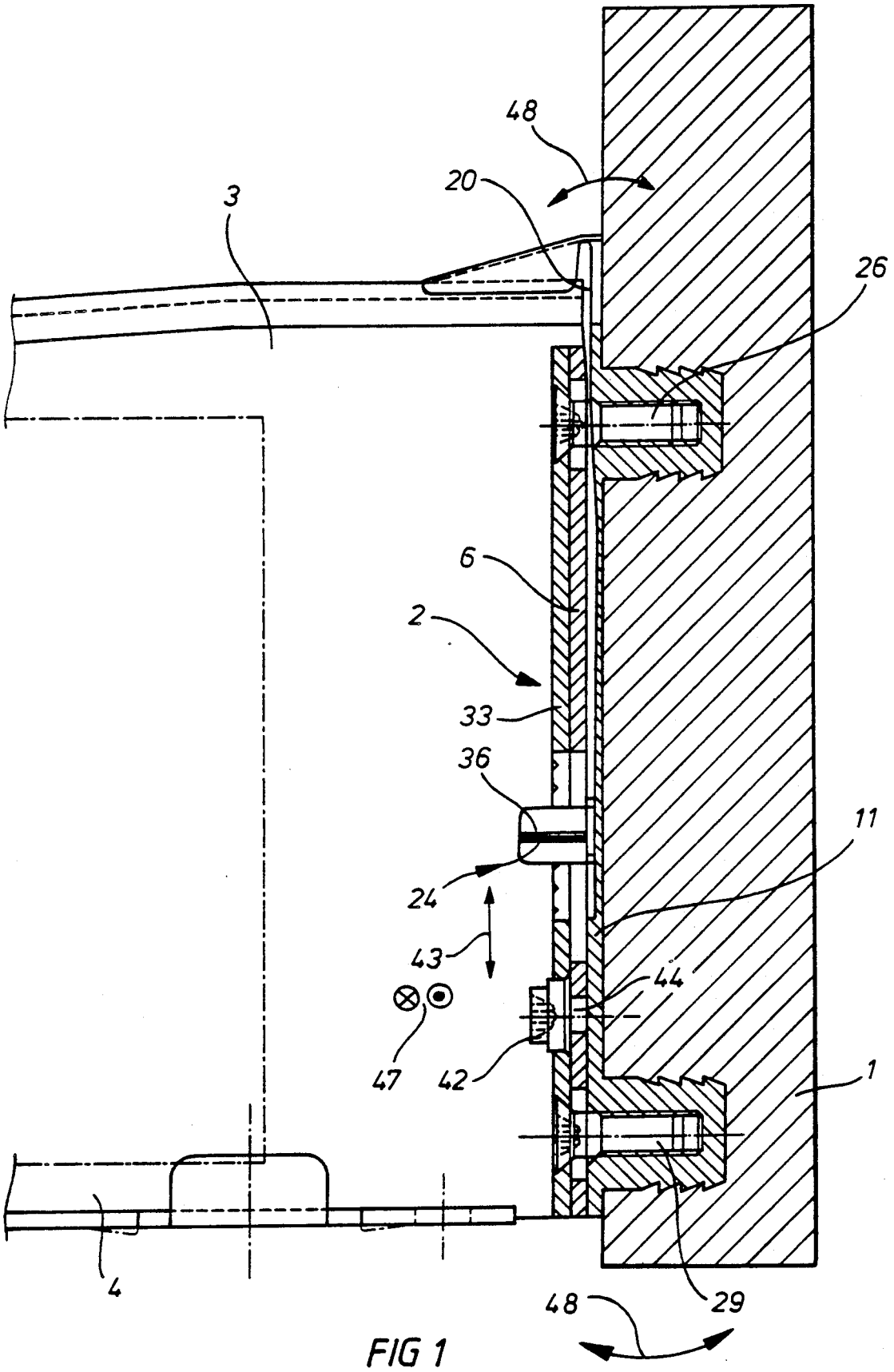
FIG. 1: Front panel positioner according to the invention in longitudinal section in the assembled condition on the end face of a frame with attached front panel

The front panel 1 of a drawer is illustrated in FIG. 1, the front panel 1 being connected with the side walls of the drawer through the front panel positioner 2.

Figure 2:
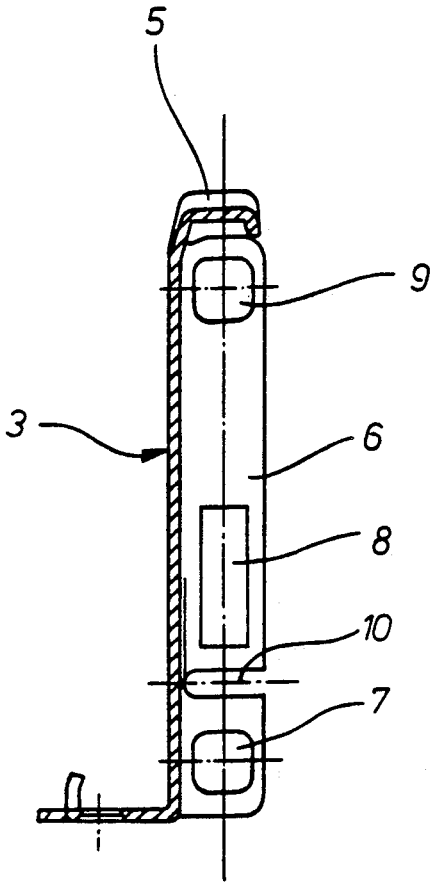
FIG. 2: End face of the frame in a partially cut-away view

The drawer side walls are designed as a frame 3 and have an end face 6 as shown in FIG. 2.

Figure 8:
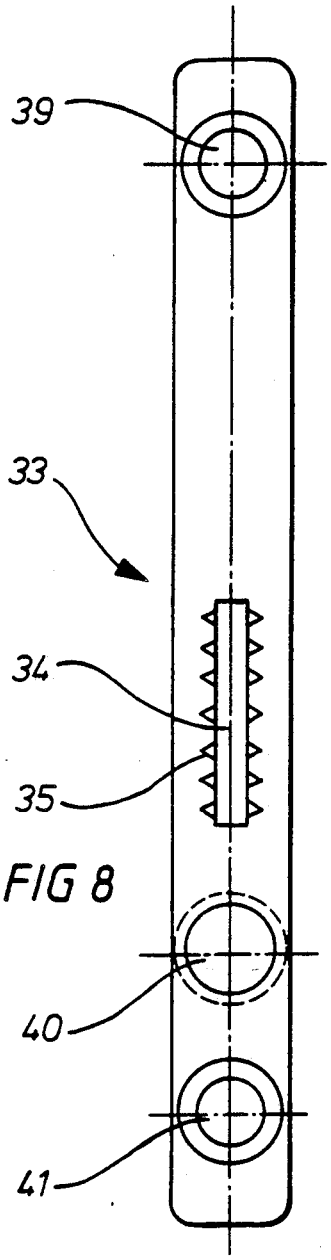
FIG. 8: Clamping plate in a plan view

The front panel positioner 2 comprises a dowel base plate 11 connected by dowels with the front panel 1, a wedge plate 24 being inserted between the dowel base plate 11 and the end face 6 of the frame for adjustment of the inclination, and a clamping plate 33 being provided on the back side of the end face, projections 36 of the positioning knob 32 of the wedge plate 24 locking in indentations 35 as shown in FIG. 8.

When the clamping wedge 24 is displaced in the longitudinal direction of the front panel positioner 2, the front panel 1 swivels in the arrow directions 48 around the fastening screw 26 or 29, depending on the inclination adjustment.

The front panel positioner 2 also comprises an eccentric screw 42 with an eccentric pin 44 for vertical adjustment of the front panel 1 in the arrow directions 43.

When the eccentric screw 42 is turned, the eccentric pin 44 is braced against the end face of the frame and the clamping plate 33 is displaced vertically with the front panel 1 fastened thereon through the fastening screws 26, 29. The inclination of the front panel 1 previously set through the wedge plate 24 remains unchanged since no relative motions changing a previously set position can take place due to the locking of the wedge plate 24 on the clamping plate 33.

For lateral adjustment of the front panel 1, the front panel positioner 2 also comprises fastening screws 26, 29 that are loosened slightly so that the front panel can be shifted laterally.

For this lateral adjustment, the fastening screws 26, 29 are displaced in the area of recesses in the end face 6, and the front panel positioner 2 in the lateral direction is also guided horizontally through the eccentric pin 44 in the slot 10 according to FIG. 2 in the end face 6, the positions in the other directions all being maintained because no relative motions can take place between them.

According to FIG. 2, the frame 3 has a flexure 5 in front, and recesses 7, 8, 9 and the slot 10 are provided on the end face 6 of the frame 3.

The recesses 7 and 9 are designed as approximately square openings in the end face 6, while the recess 8 is a rectangular recess and the slot 10 is arranged horizontally in the end wall 6 of the frame 3.

Figure 4:
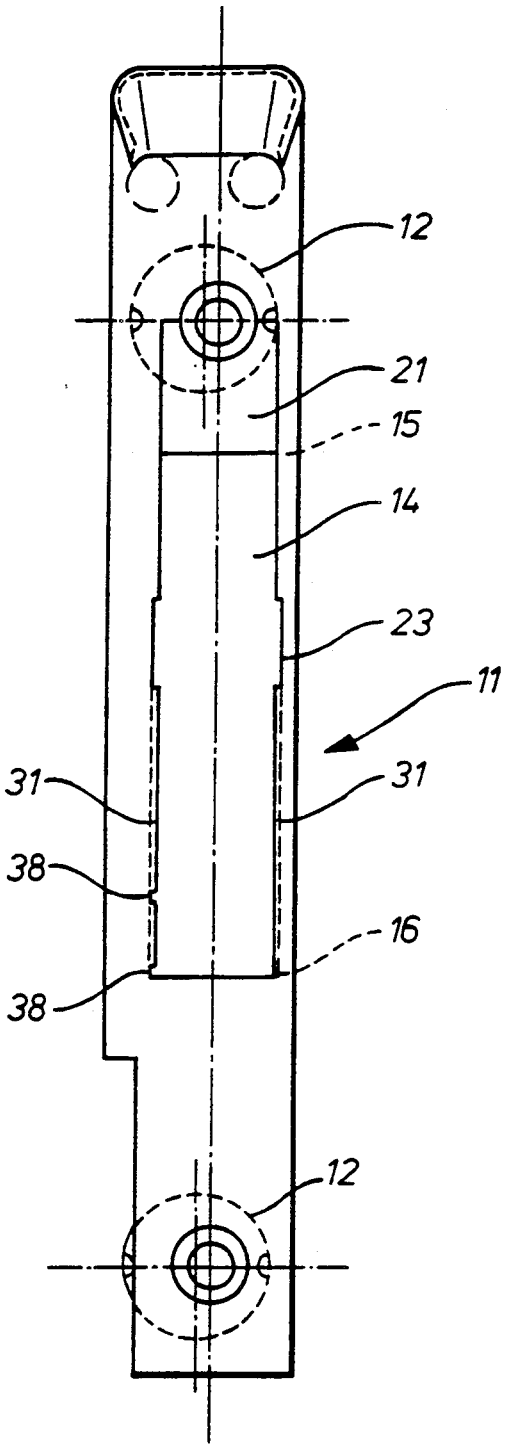
FIG. 4: Dowel base plate according to FIG. 3 in a plan view showing the wedge surfaces for receiving the clamping component
Figure 3:
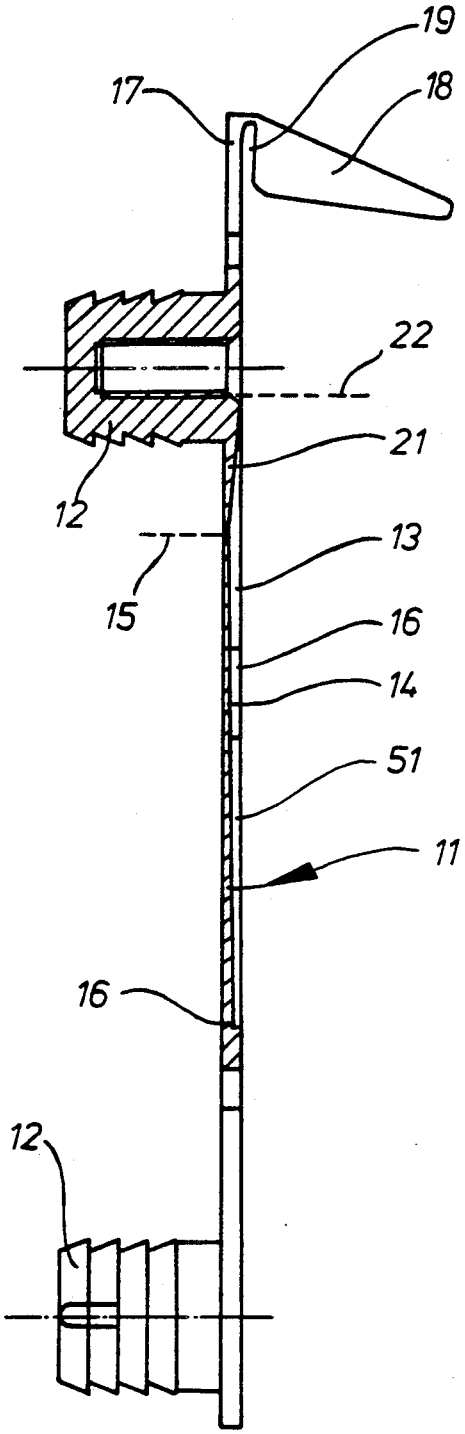
FIG. 3: Dowel base plate in a partially cut-away side view

FIGS. 3 and 4 show further details of the front panel positioner 2, particularly with respect to the dowel base plate 11. Two drive-in dowels 12 are formed on the dowel base plate 11. It is important for this dowel base plate 11 that there be a recess 13 on its plane surface with a tapering base 14 forming wedge surfaces 21, 51. The recess 13 is wedge-shaped with the wedge surface 51, particularly between the positions 15 and 16, and has a further wedge surface 21 with reference to the vertical between the positions 15 and 22.

It can also be seen in FIGS. 3 and 4 that there is a flexure 18 at the upper end 17 of the dowel base plate 11 to overlap the frame 3 in a short area of its longitudinal edge starting at the end face 6.

A slot 19 is provided in connection with this flexure 18 to provide a flexible arrangement here. This covering overlaps a joint 20 according to FIG. 1 that is otherwise present between the front panel positioner 2 and the end face of the frame.

Figure 5:
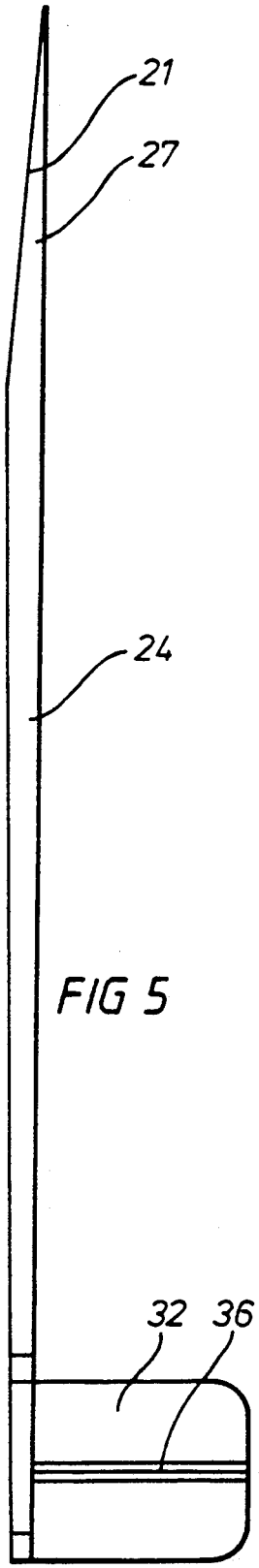
FIG. 5: Clamping wedge in a side view
Figure 6:
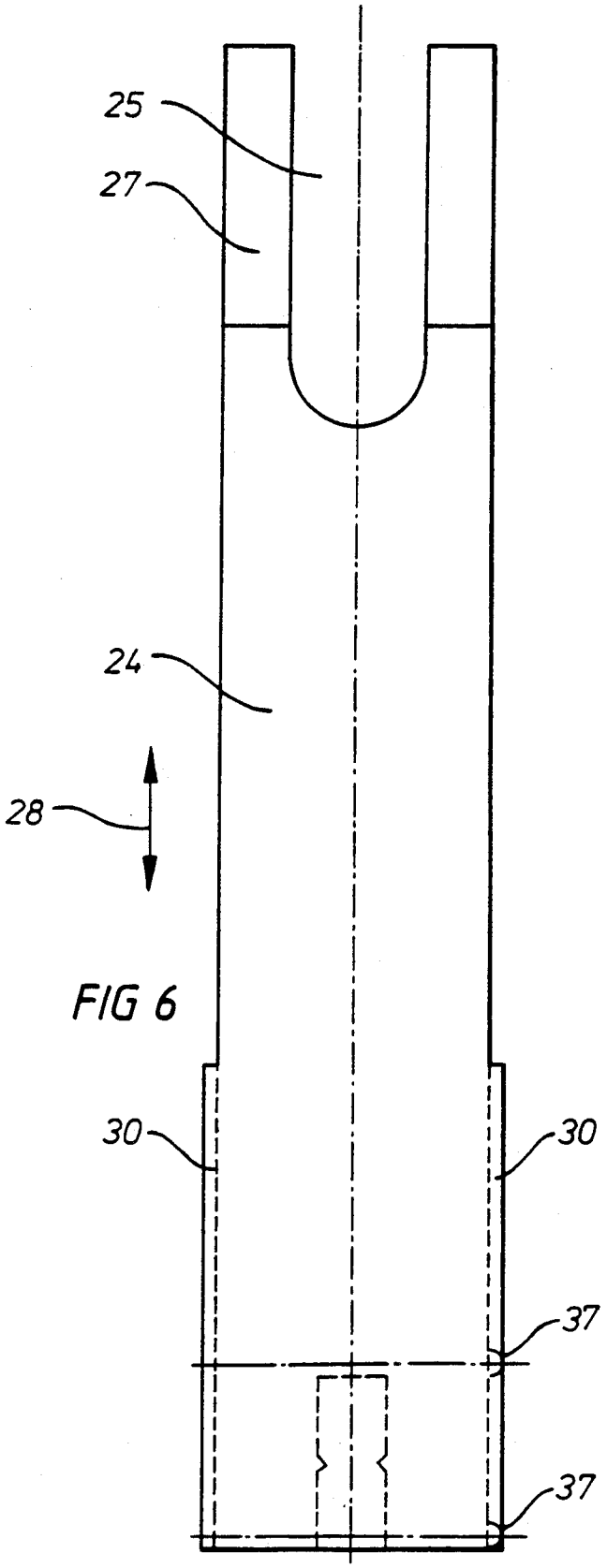
FIG. 6: Clamping component in a rear view showing the wedge surfaces

The adjustment wedge or wedge plate seen in FIGS. 5 and 6 slides in the longitudinal direction of the dowel base plate 11, depending on the desired inclination of the false front 1, on the wedge surfaces 21 or 51 in order to achieve the desired inclination of the front panel 1 through displacement of the adjustment wedge.

Figure 7:
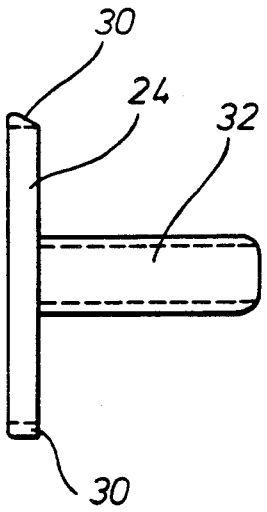
FIG. 7: Clamping wedge in a view of its rear end

According to FIG. 4, a clearance 23 is arranged in the area of the recess 13 in FIG. 3 for introducing the wedge plate 24 according to FIGS. 5 to 7 behind the end wall 6 in order to be able to press the front panel 1 on the end wall 6 in connection with an inclination on the wedge surface 21 or 51.

According to FIG. 6, the wedge plate 24 has an upper slot 25 used as a clearance for the fastening screw 26, which passes through the slot 25 with its bolt-side end.

According to FIG. 5, the forward part 27 of the wedge plate 24 is also wedge-shaped in accordance with the wedge surface 21 and cooperates as a wedge having opposing inclination with the corresponding wedge surface 21 of the dowel base plate 11.

With displacement of the wedge plate 24 in the adjustment directions 28 of FIG. 6, the inclination of the front panel 1 is thus positioned in the arrow directions 48 relative to the frame end face 6 when the fastening screws 26, 29 are loosened.

The fastening screws, particularly the fastening screw 29, do not necessarily have to be loosened; it is also sufficient to loosen only the fastening screw 26, because a slight deformation with this adjustment is acceptable in the bottom area, that is, in the area of the fastening screw 29 and conversely with another direction of the inclination of the front panel 1. It is important here that the previously carried out vertical and lateral position of the false front 1 not be changed with this kind of positioning.

Thus, when the inclination is adjusted in the arrow directions 48, the height in arrow direction 43 according to FIG. 1 and the lateral positioning in arrow direction 47 are not adjusted, that is, they remain unaffected.

This could not be achieved in this way with the prior art; there was the risk that adjustment of one or two directions would also mean adjustment of another direction and vice versa.

According to FIG. 6 and 7, the wedge plate 24 is provided at the lateral surfaces with tapered bevels 30 that engage a guide 31 having the same shape on the dowel base plate 11 according to FIG. 4.

This provides a land over the tapered surfaces in the area of the guides 31 so that the wedge plate 24 cannot tilt or seize during displacement in the arrow directions 28 according to FIG. 6.

In order to design the inclination set with a kind of self-locking, a stop of the positioning knob 32 (FIG. 7) of the wedge plate 24 is provided.

According to FIG. 8, a clamping plate 33 is used here, which is arranged according to FIG. 1 on the back side of the end face 6 of the frame 3 and, as part of the front panel positioner 2, causes a clamping and self-locking of the positioning means.

The clamping plate 33 has an approximately central recess 34 with all indentations 35 in a tooth-like spaced arrangement on opposite sides.

The positioning knob 32, on the other hand, has an arrangement of rib-like projections (FIG. 5), which, in connection with the assembled arrangement according to FIG. 1, engage the tooth-like indentations 35 to form a locating device.

To set an advantageous zero position between the wedge plate 24 and the dowel base plate 11, projections 37 are provided on the bottom part of the wedge plate 24, which engage associated recesses 38 on the bottom part of the dowel base plate 11.

This kind of zero or base position is provided right at the factory in order to supply a front panel 1 where angular deflections from the frame 3 are not yet formed.

Only after the projections 37 according to FIG. 6 disengage from the recesses 38 according to FIG. 4 on the dowel base plate 11 is the inclination of the front panel 1 positioned accordingly, the fastening screw 26 or 29 being loosened depending on the inclination. However, both fastening screws can be loosened for setting the inclination as is otherwise provided for a lateral adjustment of the front panel 1 as well.

Figure 9:
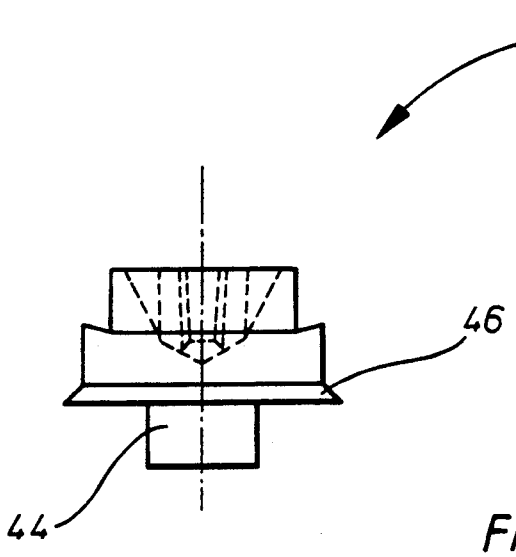
FIG. 9: Eccentric screw in a side view

There is self-locking here, too, particularly with respect to lateral displacement of the front panel 1, because the eccentric pin 44 according to FIG. 9 is, according to FIG. 1, continuously engaged with the end face 6 of the frame, particularly in the area of the slot 10 according to FIG. 2, which gives rise, even when the fastening screws 26, 29 are loosened, to self-locking forces that prevent displacement of the false front 1 when being positioned in another direction.

According to FIG. 8, a clamping plate 33 is provided that has an upper hole 39 and bottom holes 40, 41. The hole 39 serves for penetration of the fastening screw 26, while the bottom hole 41 serves for penetration of the fastening screw 29.

Furthermore, the hole 40 receives the eccentric screw 42 provided for vertical positioning. Vertical positioning is carried out here in the arrow direction 43 according to FIG. 1, particularly with the fastening screws 26 and 29 loosened. It is important here that the positioning wedge 24 maintain its location once set on the clamping plate 33 by the stop, which makes it possible for the vertical positioning in the arrow directions 43 to be carried out completely independently of the inclination displacement in the arrow directions 48 according to FIG. 1.

For vertical positioning in the arrow directions 43, the eccentric screw 42 has an eccentric pin 44 that engages the slot (FIG. 2) in the frame 3 on the end face 6.

The diameter of the pin 44 is less than the height of the slot 10 to allow a certain amount of adjustment play.

Figure 10:
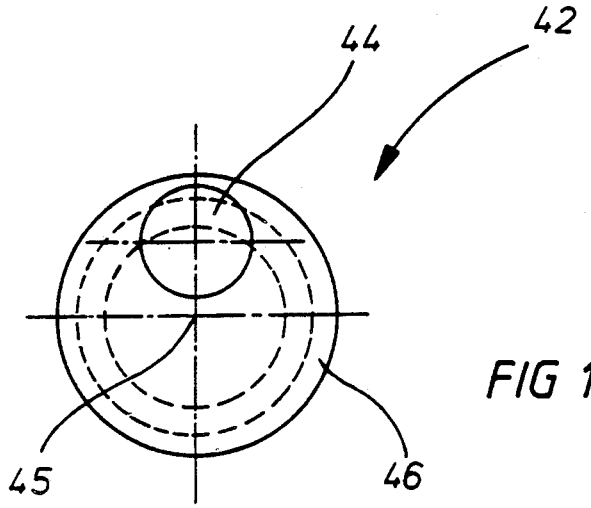
FIG. 10: Eccentric screw according to FIG. 9 in a plan view

Once the pin 44 is eccentric with respect to the center axis 45 (FIG. 10) of the eccentric screw 42, the adjustment is carried out with a turn of the eccentric screw 42 in that the outer collar 46 is braced against the plate 33 in the area of the recess 40 and the eccentric pin 44 engages the slot 10 of the end face 6 at the same time. Thus, the plate 33 is displaced vertically in the arrow directions 43 according to FIG. 1 together with the dowel base plate 11 in relation to the frame 3, that is, in relation to the end face 6.

The following is a more detailed description of the lateral adjustment of the front panel 1 in the arrow directions 47 vertical to the drawing plane of FIG. 1.

The lateral adjustment is carried out here in the area of the longitudinal axis of the slot 10 according to FIG. 2.

The inside diameter of the recesses 7 and 9 serving for penetration of the threaded bolts of the fastening screws 26 an 29 is substantially greater than the diameter of these end face bolts so that a lateral displacement of the front panel 1 takes place in the area of the recesses 7 and 9.

Following slight loosening of the two fastening screws 26, 29 on the right and left frame sides, the front panel can, possibly with application of slight pressure as a kind of self-locking of the fastening screws 26, 29, be displaced toward the side, that is, in the arrow directions 47 in FIG. 1 without this affecting the other directions set in the arrow directions 43 and 48.

The pin 44 is displaced in the area of the slot 10 without the eccentric screw 42 itself turning with the advantage that the height set in arrow directions 43 is not changed.

To prevent the eccentric screw 42 from falling out, the collar 46 according to FIG. 9 is tapered and is housed in the also tapered hole 40 according to FIG. 8 so that the eccentric screw cannot slip forward, that is, toward the inside of the drawer.

The eccentric screw 42, that is, rolling of the eccentric collar 46 according to FIG. 9 on the associated hole 40 according to FIG. 8, is self-locking so that the height in the arrow directions 43 is not changed with the displacement in arrow direction 47 in accordance with the lateral positioning shown in FIG. 1.

Figure 11:
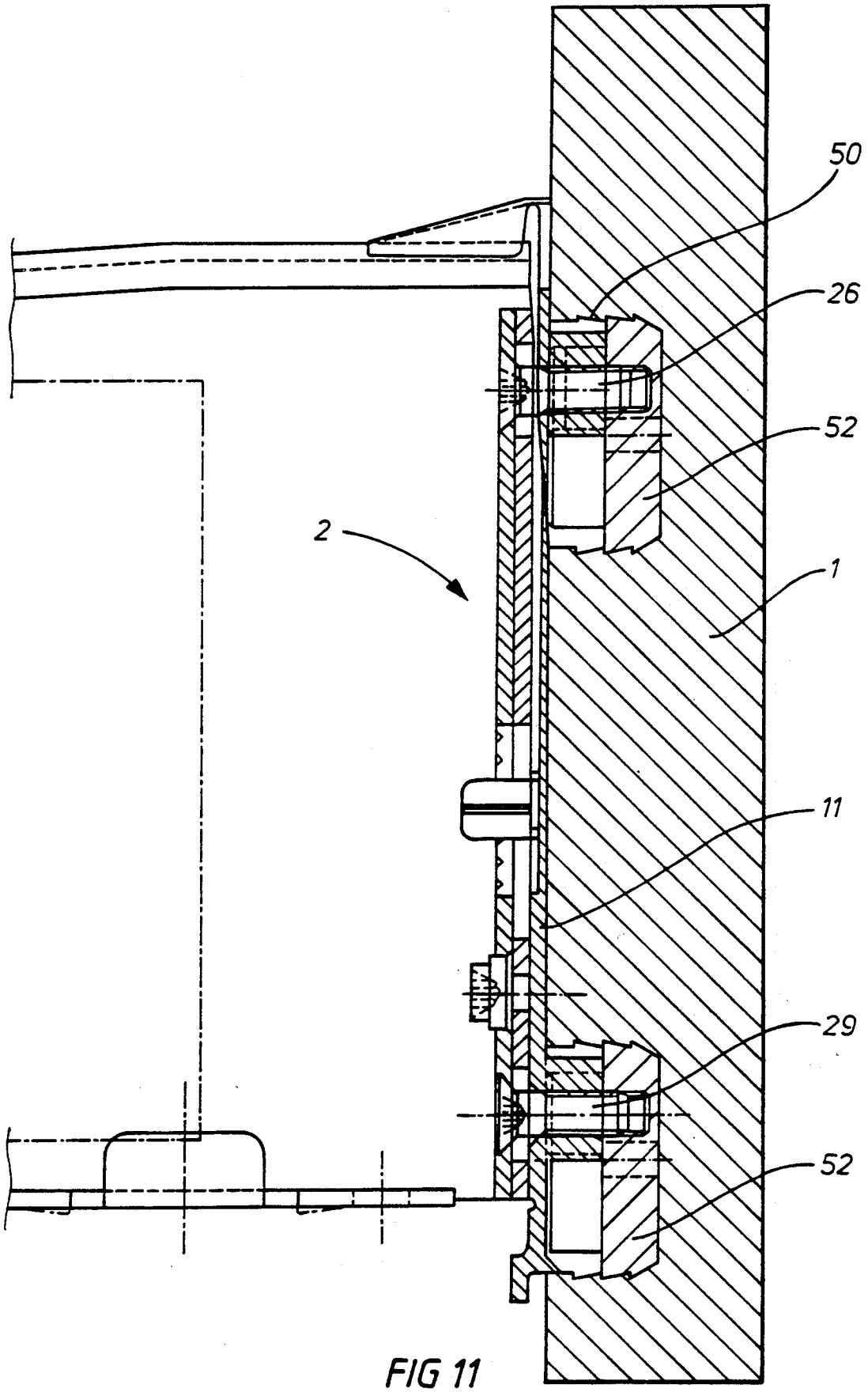
FIG. 11: Example embodiment for positioning the false front with a front panel positioner, where the front panel is clipped on the positioner through furniture connectors

FIG. 11 illustrates a further example embodiment of the front panel positioner 2. It is seen that the front panel 1 is clipped by means of furniture connectors onto the front panel positioner 2.

Engaging means are used in particular to slip the front panel 1 onto the already explained adjustment and fastening means of the panel front positioner 2 and lock it in place.

According to FIG. 11, there are serrated holes 50 in the area of the front panel 1 that have barb-like projections.

Starting at the dowel base plate 11, pincer-like clamping components are introduced into these serrated holes 50, which cooperate with an opposite component or with clamping components 52.

The connection where the front panel 1 is clipped onto the false front positioner 2 according to FIG. 11 is designed along the lines of connection fittings with provision on one side of non-deforming clamping components (e.g., collet or displaceable wedge), which cause the locking effect in the area of the holes 50 of the front panel 1.

Furthermore, the connection fittings are designed so that a certain fitting component is deformed so as to locate the false front 1 on the front panel positioner.

For clipping the front panel 1 onto the front panel positioner 2 along the lines of a snap-on connection, the force-transferring surfaces of the fitting parts braced against each other are designed in particular as wedge surfaces that can be clamped against each other and disengaged as necessary by means of a clamping component.

One clamping component is designed as a collet with dogs having wedge surfaces lying on associated wedge surfaces of the other fitting component, for example, of the front panel 1.

Furthermore, the collet halves can be designed to be braced against each other and disengaged by means of an additional eccentric screw.

Provision is also made for the collet halves to be designed as one piece and connected, in particular to be flexible and expandable with engaging means, starting at the front panel 1.

In this respect, the clamping component can also be a displaceable wedge which, when displaced, spreads a clamping sleeve with wedge surfaces that brace against associated wedge surfaces on the front panel 1, for example.

For deforming engagement of the front panel 1 with the false front positioner 2, a clamping component in the area of the front panel 1, for example, is designed to be elastically deformable with an elastically expandable groove in which the head of a screw can be pressed starting at the front panel positioner 2 in order to bring about a locking connection.

The only important thing with an arrangement according to FIG. 11 for positioning the front panel of drawers or the like is that, even without the front panel 1, the front panel positioner is already oriented with respect to inclination either or both and vertically and laterally, and the front panel 1 is then clipped on, or the front panel 1 can be easily withdrawn from the front panel positioner 2 after positioning is carried out, which make positioning mechanism easily accessible and facilitates further manipulation of the pre-positioned frame without front panel 1.

What is claimed is:

1. A device for positioning the front panel of a drawer on an end face having opposing front and back sides of a respective lateral frame rail of the drawer comprising:

a base plate attached to the front panel for mounting the front panel on the front side of the end face of the frame rail for slideable vertical and lateral movement relative to the end face;

a clamping plate mounted on the back side of the end face of the frame rail and connected to the base plate by first and second mounting screws for corresponding slideable vertical and lateral movement relative to the end face; and a wedge plate arranged between the base plate and the front side of the end face for adjusting the inclination of the front panel by swiveling said panel relative to the end face of the frame rail independent of vertical or lateral movement of the front panel, the wedge plate having a positioning knob including a pair of projections, and the clamping plate having indentations for engaging the projections of the positioning knob.

2. A device as claimed in claim 1 wherein the end face of the frame rail has first and second holes formed therein for receiving the first and second mounting screws and dimensioned to allow vertical and lateral displacement of the mounting screws therein relative to the end face, a third hole formed therein for receiving the positioning knob of the wedge plate and dimensioned to allow vertical displacement of the positioning knob therein relative to the end face, and a horizontal slot formed therein having opposing lateral edges, and wherein displacement of the wedge plate during vertical and lateral movement of the front panel is prevented by the indentations of the clamping plate engaging the projections of the positioning knob of the wedge plate.

3. A device as claimed in claim 2 wherein the wedge plate includes a pair of projections and the base plate includes a pair of corresponding recesses for locking the wedge plate in a predetermined position relative to the base plate.

4. A device as claimed in claim 3 wherein the wedge plate includes a pair of laterally tapered bevels and the base plate includes corresponding guides guiding the laterally tapered bevels.

5. A device as claimed in claim 4 wherein the wedge plate further comprises first and second wedge portions and the first wedge portion includes a slot for receiving the first mounting screw.

6. A device as claimed in claim 5 wherein the base plate is provided with a recessed region including first and second wedge surfaces having opposite inclinations.

7. A device as claimed in claim 6 wherein the base plate includes an upper end, the end face of the frame rail includes a longitudinal edge, and the upper end of the base plate is provided with a flexure including a pair of lateral locking legs forming a slot for clasping the longitudinal edge of the frame rail.

8. A device as claimed in claim 2 further comprising an eccentric screw connected to the clamping plate, the eccentric screw having an eccentric pin extending into the slot formed in the end face of the frame rail and braced against one of the lateral edges of the slot formed in the end face.

9. A device as claimed in claim 2 wherein lateral adjustment of the front panel is made by lateral displacement of the first and second mounting screws within the first and second holes formed in the end face of the frame rail with corresponding lateral displacement of the clamping plate.

10. A device as claimed in claim 7 wherein adjustment of the inclination of the front panel is made by swiveling said panel around a fixed fulcrum formed by one of the mounting screws by vertical displacement of the wedge plate relative to the base plate and the front panel.

11. A device as claimed in claim 8 wherein vertical adjustment of the front panel is made by rotating the eccentric screw with the eccentric pin braced against one of the lateral edges of the slot formed in the end face displacing the clamping plate vertically relative to the end face while the projections of the positioning knob of the wedge plate are engaged by the indentations of the clamping plate and lateral displacement of the clamping plate and front panel relative to the end face is prevented by frictional contact with the end face by tightening of the mounting screws.

12. A device as claimed in claim 9 wherein vertical displacement of the front panel is prevented during lateral adjustment of the front panel by the eccentric pin guided in the horizontal slot formed in the end face of the frame rail.

13. A device is claimed in claim 12 wherein the projections of the positioning knob of the wedge plate are engaged by the indentations of the clamping plate during lateral adjustment of the front panel.

14. A device as claimed in claim 13 wherein the front panel is attached to the base plate by releasable connectors.

* * * * *